United States Patent [19]

Chapel

[11] 4,237,577

[45] Dec. 9, 1980

[54] SAFETY HINGE

[76] Inventor: Lesley Chapel, 9211 Haas Ave., Los Angeles, Calif. 90049

[21] Appl. No.: 957,359

[22] Filed: Nov. 3, 1978

[51] Int. Cl.[3] ..... E05D 11/00

[52] U.S. Cl. ..... 16/137; 16/171; 16/DIG. 29

[58] Field of Search ..... 16/128 R, 137, 174, 16/139, 149, 166, 191, DIG. 17, DIG. 29, 189, 168, 169, 171

[56] References Cited

U.S. PATENT DOCUMENTS

| | | | |
|---|---|---|---|
| 721,641 | 2/1903 | Whitehead | 16/DIG. 29 |
| 2,587,818 | 3/1952 | Caldwell et al. | 16/DIG. 29 |
| 2,655,686 | 10/1953 | Summersgill | 16/DIG. 29 |
| 2,774,098 | 12/1956 | Tieri | 16/169 X |
| 3,526,922 | 9/1970 | Kellems | 16/128 R |
| 3,826,565 | 7/1974 | Wenzel | 16/169 X |

FOREIGN PATENT DOCUMENTS

| | | | |
|---|---|---|---|
| 249080 | 3/1948 | Switzerland | 16/168 |
| 273654 | 5/1951 | Switzerland | 16/DIG. 29 |

*Primary Examiner*—George H. Krizmanich
*Attorney, Agent, or Firm*—Howard L. Johnson

[57] ABSTRACT

Three piece separable hinge assembly wherein, when closed or nested, a smaller flat leaf is received loosely, coplanar, within a central cut-out area of a larger flat leaf so that the composite hinge occupies the thickness of only one leaf. When this thickness corresponds to the shallow recess or seating niche of an attached structure (e.g. either door or door jamb) to which the leaf is secured, such door can be completely closed without leaving an appreciable gap between it and the adjacent wall. Each leaf, along a common edge, is formed with a jointly aligned bearing tube, which tubes house a cylindrical hinge pin having a tapered, distally converging, engagement neck and flared head. Such pin is removably insertable from either end of the tube. Longitudinally spaced along the bearing tube of the smaller leaf are a pair of tangentially projecting abutment lugs which serve to locate one connected structure (e.g. door) for automatic alignment with the other (e.g. door jamb) when the leaves are coupled together by insertion of the hinge pin. Loose but locking engagement of the smaller leaf edge with the adjacent bearing tube of the larger leaf prevents separation of the nested leaf pair even in the absence of the hinge pin; that is, the closed door can not be opened merely by withdrawing the hinge pins.

2 Claims, 11 Drawing Figures

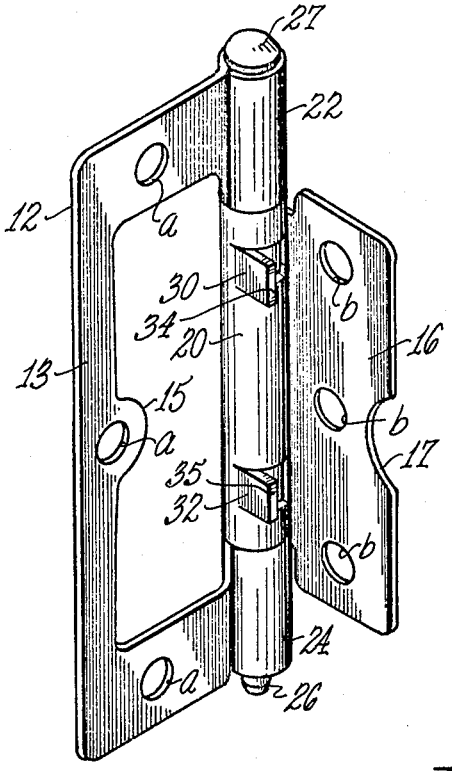
FIG. 6.
FIG. 7.
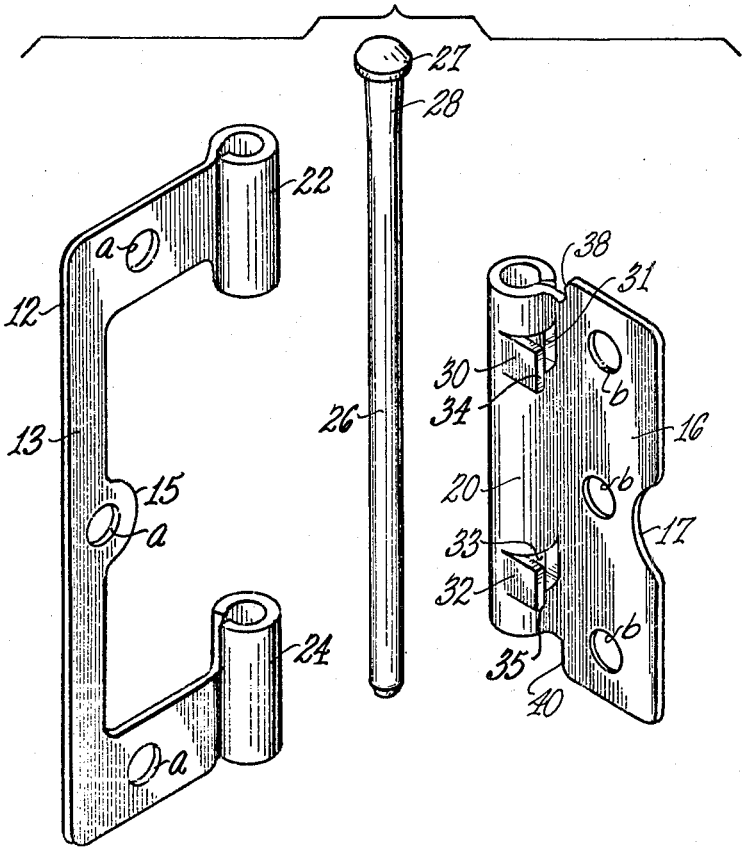

SAFETY HINGE

BACKGROUND OF THE INVENTION

Carpenters and other workmen who need to attach a hinge assembly to a door and doorjamb (or similary place a pair of hinge leaves horizontally along an out-folding bin panel, etc.) usually have to measure and mark off the exact location for each hinge plate, that is, on each of the adjacent support structures both as to height and for lateral location along an end wall such as a door jamb. Some effort has been made to make this lateral alignment measurable by the hinge itself. Thus U.S. Pat. No. 3,526,922 to Kellems provides projecting contact collars (formed integral with corresponding pintles which therefor are not removable). However this merely places the spine or pintle axis equa-distant from both structures (door and door jamb), while keeping the latter separated by the thickness of the leaves. All emphasis appears to be on flush-aligning the two panel faces 34*a*, 35*a* FIG. 4 of Kellems, which are on the projecting hinge-pin side of the door. This is seldom a problem.

In the West German Pat. No. 820,864, there are provided edge abutment shoulders $a^3$, $b^3$ for each panel along the spine side of the hinge. This still leaves a gap Y between the end surfaces FIGS. 4, 6, or Z, FIGS. 3, 5; in either event, the only support between the panel or door jamb and its hanging door is the short height [length] of the hinge(s).

This tendency to align only the spine-face of adjacent panels appears likewise in U.S.Pat. No. Des. 175,366 to Schoen and Belaschk where each leaf carries a pair of abutment lugs which are not in the same plane; i.e. the adjacent thus-coupled panels would be UNaligned (to the extent seen in either FIG. 2 or FIG. 4). That is, the spine faces of the panels would be disposed parallel but with one horizontally displaced from the plane of the other. In all three of these examples, there is no concept of seating both hinge leaves in a single thickness [or indeed ANY] edge recess; nor of a hinge pin held against rotation in the bearing of only one leaf, which in addition is removable without the leaves being separable as long as they remain closed and mounted.

SUMMARY

Accordingly it is an object of the invention to provide a nested leaf hinge assembly wherein the pair of nested leaves can be completely lodged or seated flat (juxtaposed) within a corresponding structural edge recess of single-leaf thickness (thereby allowing the opposite faces of thus hinge-coupled coplanar panels to be disposed flush with each other without any gap caused by the mounted hinge(s)), such assembly also having a detachable and anchorable hinge pin (thus allowing each leaf to be attached when separated but to be locked against separation when the pair is closed, even with the pin removed). Further, one leaf only of the pair is formed with tangential abutment lugs for locating it along a structural mounting edge (e.g. a door), thus not pre-commiting the adjacent panel to any theoretical position. A pin-withdrawable mounting feature is obtained by use of a cylindrical hinge pin (lenthwise insertable through aligned bearing tubes of the pair of flat-faced hinge leaves) which pin has a flared head and tapered neck immediately therebeneath, so that the tapered area frictionally engages [transiently locks] a segment of the bearing tube. A safety or non-separable feature is obtained as a result of the smaller leaf extending lengthwise (adjacent its bearing edge) so as to closely overlie the bearing tube of the larger leaf and thus lock against the latter upon attempted planar separation of the smaller leaf from the nested assembly, even in the absence of the hinge pin.

BRIEF DESCRIPTION OF THE DRAWINGS

FIG. 6 is a perspective thereof with the leaves in a partially open position.

FIG. 7 is an exploded perspective view of the elements of FIG. 6.

DETAIL DESCRIPTION OF PREFERRED EMBODIMENT

Figure 1:
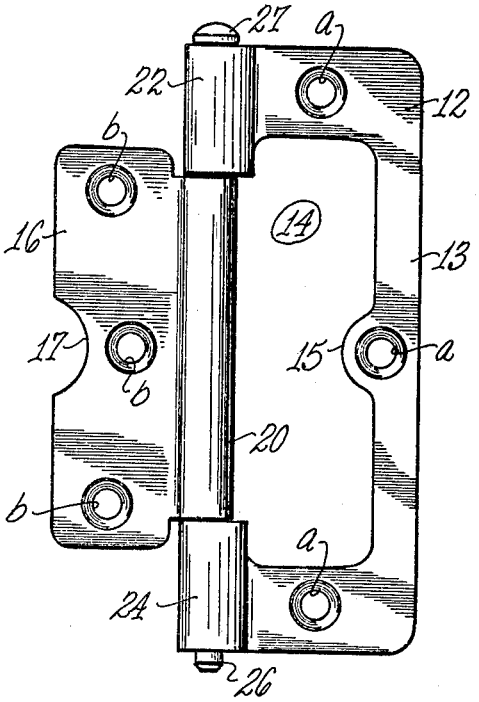
FIG. 1 is a face view of the Safety Hinge with the pair of pin-coupled leaves disposed approximately 180° to each other.
Figure 2:
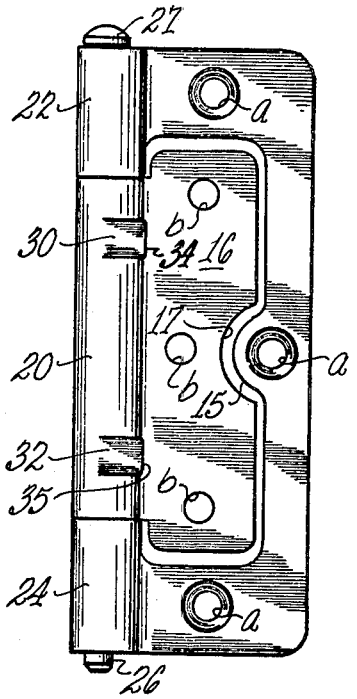
FIG. 2 is an elevational view of the right leaf shown in the same position as FIG. 1, with the left leaf swung 180° to the right from its FIG. 1 position so as to dispose both leaves nested or coplanar.
Figure 3:
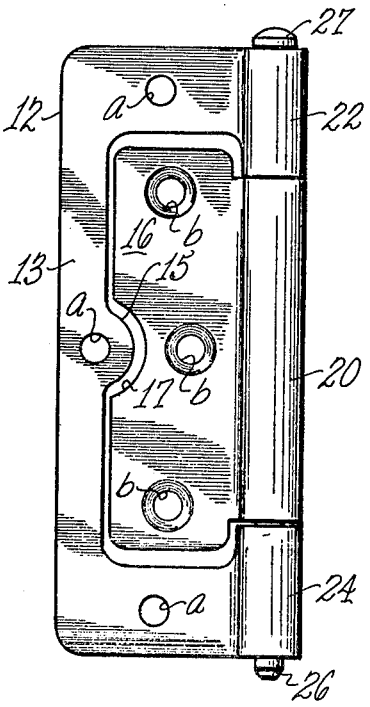
FIG. 3 is a rear elevational view of the nested or closed assembly in FIG. 2.
Figure 4:
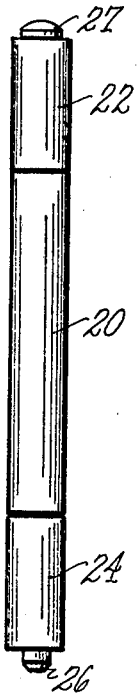
FIG. 4 is an edge elevational view taken from the left of FIG. 2.
Figure 5:
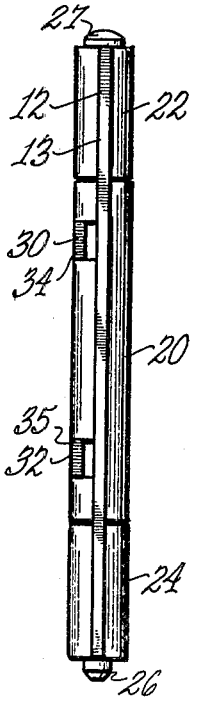
FIG. 5 is an edge elevational view taken from the right of FIG. 2.
Figure 8:
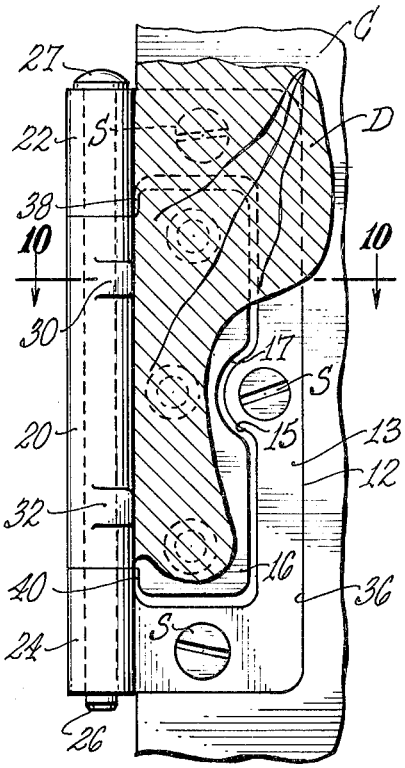
FIG. 8 is a detail elevational view of the Safety Hinge coupled nested to adjacent panels, part of the nearer panel being broken away.
Figure 9:
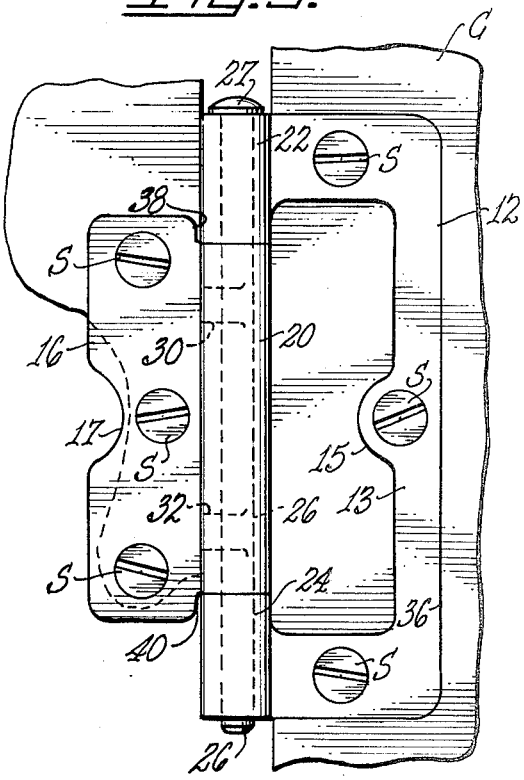
FIG. 9 is a similar view with the hinge leaves open 180°.

The present hinge assembly provides a pair of generally rectangular, flat faced leaves of which the larger 12 is formed with a central cut-off area 14 within which the smaller leaf 16 can be loosely swung or nested, the pair of leaves having the same thickness. A central scallop or edge recess 17 of the small leaf 16 corresponds to an arcuate buldge or projection 15 along the longer arm 13 of the large leaf 12. Each leaf has a trio of cup shaped apertures a, b for insertion of screws or other fasteners into a support structure such as a door and door jamb.

One edge of each leaf is rolled or turned to form a generally cylindrical bearing tube 20 for the smaller leaf and the two segments 22, 24 for the larger leaf. When all three tubes are in longitudinal alignment (as after each leaf is attached to a different structure such as door and door jamb) they can lengthwise receive a cylindrical hinge pin 26. The pin has a peripherally flared, dome-shaped head 27 with a short distally converging, tapered or frustro-conic neck 28 immediately therebeneath.

The intermediate bearing tube 20 is formed with a pair of tangentially projecting abutment members or positioning lugs 30,32 axially spaced apart along the tube, which lugs overlie corresponding arcuate apertures 31, 33 of the bearing tube 20. Thus their contact ends 34, 35 may be pressed against the edge of a structural member or panel, in this case the door D, against the side face of which the smaller leaf 16 is then fastened, as by screws S. The larger leaf (unconnected) is secured in a corresponding edge recess 36 of the other support structure (door jamb C). The door D is then held angularly open to align the several bearing tube sections and a hinge pin 26 dropped in and seated by a hammer blow to force down the tapered neck 28.

Figure 10:
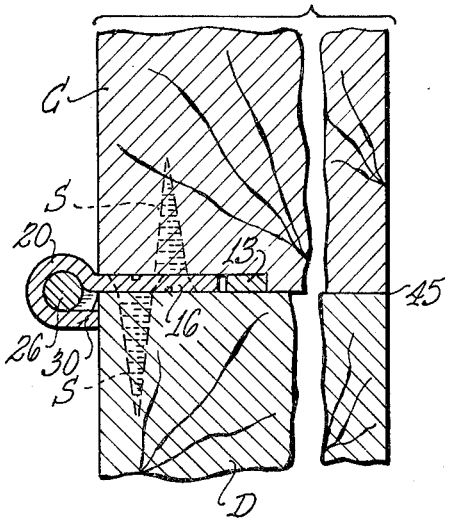
FIG. 10 is a transverse sectional view taken along the line 10—10 of FIG. 8.
Figure 11:
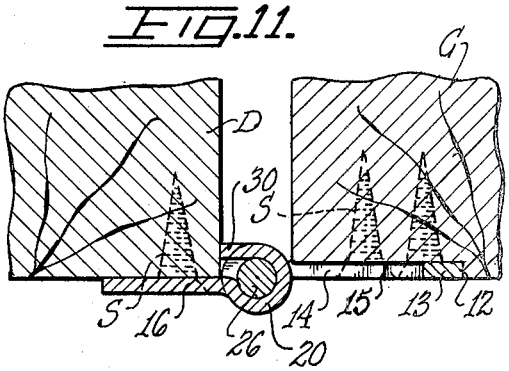
FIG. 11 is a corresponding sectional view taken through the open leaves of FIG. 9.

It will be seen that when the pair of leaves 12, 16 are nested, that is, both seated in the single thickness edge recess 36 by the door D being closed (its opposite edge latched or otherwise locked), removing the hinge pins 26 (from the opposite side of the door or wall) still does not permit the door to be removed from the door frame, as long as it remains latched. This is because the longitudinally extended corners 38, 40 of the smaller leaf 16 abut against the tube segments 22, 24 of the larger leaf 12. Also, when thus closed, along the face opposite the hinge pins and bearing tubes, the adjacent edges of the door D and door jamb C come together (at 45, FIG. 10) without leaving a gap. This can be effected either for security purposes or for concealment, that is, such door along this face being indistinguishable from the adjoining wall. When concealment is the primary requirement, the panel faces along the hinge side will not necessarily be disposed in the same plane (when closed); and the "exposed" side 45 may also lack a handle or other projecting fixture which would call attention to the presence of a door, that is, it may be openable only from the hinge side.

I claim:

1. A three piece, separable, safety hinge comprising in combination:

a pair of hinge leaves each consisting of a parallel-faced flat area of approximately equal thickness but different lengths, said pair consisting of a larger length leaf formed with a central cut-out area and a smaller length leaf loosely receivable nested coplanar within said cut-out area, each leaf having means for respective attachment to an adjacent support structure such as a door and door jamb so as thereby to hinge them together, each leaf having a bearing tube formed along a common edge, the bearing tube of both leaves being functionally disposable in joint longitudinal alignment, the bearing tube of said smaller leaf being formed with a pair of tangentially projecting abutment lugs adapted to locate an edge of one of said support structures disposed thereagainst for attaching said smaller leaf thereto, and a flat portion of said smaller leaf extending within said cut-out area lengthwise beyond its adjacent bearing tube in both directions so as to longitudinally overlie the bearing tube of the larger leaf and thus prevent separation of the two leaves when the letter are disposed nested coplanar with each other, and a hinge pin characterized by a generally cylindrical shaft with a peripherally enlarged head and a distally converging, frustro-conic neck immediately beneath, which neck is frictionally engagable by insertion within said bearing tubes, whereby said pin may be removably inserted through the aligned bearing tubes and transiently engage its frustro-conic neck therewith from either end when so inserted.

2. A pair of adjacent support panels hingedly connected along a common adge by a pair of the safety hinges of claim 1, each hinge being mounted in an edge recess of one of said panels, said recess being only the thickness of one of said nested leaves, whereby adjacent panels thus hinged together may, upon the leaves of said pair of hinges being disposed nested in said recesses, be disposed coplanar without an appreciable gap therebetween along the hinge-bearing intersection, said one panel being inseparable from the other panel as long as the hinge leaves remain nested in their recesses, even with said hinge pins removed.

* * * * *